United States Patent [19]

Williams

[11] 4,232,694

[45] Nov. 11, 1980

[54] SIPHON

[76] Inventor: Francis R. Williams, 500 Lunalilo Home Rd., Apt. 16F, Honolulu, Hi. 96825

[21] Appl. No.: 4,772

[22] Filed: Jan. 19, 1979

[51] Int. Cl.[3] ..... F04F 10/00

[52] U.S. Cl. ..... 137/1; 137/148

[58] Field of Search ..... 137/1, 147, 148, 149, 137/150

[56] References Cited

U.S. PATENT DOCUMENTS

| | | | |
|---|---|---|---|
| 11,867 | 10/1854 | Lenher . | |
| 108,087 | 10/1870 | Averellet al. . | |
| 108,652 | 10/1870 | Trapp . | |
| 135,935 | 2/1873 | Paynter . | |
| 201,746 | 3/1878 | Cardarelli . | |
| 919,079 | 4/1909 | Richards . | |
| 958,415 | 5/1910 | Meade . | |
| 1,083,228 | 12/1913 | Stuart . | |
| 1,088,973 | 3/1914 | Drinkhouse . | |
| 1,241,916 | 10/1917 | Brown | 137/148 |
| 1,440,706 | 1/1923 | Taylor . | |
| 1,731,899 | 10/1929 | Huntworth . | |
| 2,233,123 | 2/1941 | Fritts . | |
| 2,830,608 | 4/1958 | Miller . | |
| 2,864,396 | 12/1958 | Isreeli . | |
| 3,588,293 | 6/1971 | Morales . | |
| 4,112,963 | 9/1978 | Brubaker | 137/148 |

FOREIGN PATENT DOCUMENTS

| | | | |
|---|---|---|---|
| 212598 | 7/1956 | Australia | 137/150 |
| 909052 | 4/1954 | Fed. Rep. of Germany | 137/148 |
| 4612 | of 1895 | United Kingdom | 137/150 |

*Primary Examiner*—Gerald A. Michalsky

*Attorney, Agent, or Firm*—James Creighton Wray

[57] ABSTRACT

A siphon is formed of a long transparent main siphon tube having a distal end for insertion in a tank from which fluid is to be siphoned and having a proximal end. A smaller diameter transparent connection tube fits tightly within the main siphon tube at a proximal end but slides freely from the main siphon tube. An evacuating pump has a nipple connected to the inlet end, and the nipple fits tightly within a proximal end of the connection tube. After the distal end of the main siphon tube is placed in a tank, one pulls once or more on the plunger of the pump while gripping the proximal end of the main siphon tube and thus holding the connection of the main siphon tube and the connection tube. When fluid raises to a desired level in the siphon tube, a continued outward pull on the plunger past its normal limits and a simultaneous loosening of the grip on the proximal end of the siphon tube causes withdrawal of the pump and connection tube from connection with the main siphon tube, permitting the fluid to freely flow from the proximal end of the main siphon tube.

9 Claims, 4 Drawing Figures

SIPHON

BACKGROUND OF THE INVENTION

The nationwide gasoline shortage has caused a considerable amount of activity in siphoning gasoline from one automobile tank to another. Consequently, there has been a run on local stores to buy lengths of plastic tubing for that purpose. There has also been an increased run to hospitals for many who have inhaled or have swallowed gasoline after using their mouth to evacuate the tubing to start the siphoning action. Gasoline in the mouth may cause discomfort or burns; swallowed gasoline is extremely serious; inhaled gasoline sometimes causes critical conditions. Either inhaling or swallowing gasoline may cause fatalities. Many of the people who borrow or transfer gas from car to car or from tank to tank are young, dynamic people who are strong and healthy and who have sufficiently strong lungs to start the siphoning action. It is precisely those people that eschew difficult-to-use transfer equipment because of impatience or for other reasons. It is precisely those people which are most fearless and least concerned about health problems, since often they have none. Usually those people are not aware of the extremely high risks that are taken by starting siphoning action by mouth.

There are many siphoning devices on the market, and many siphoning devices have been invented. Many marketed devices are constructed of thin, inexpensive plastic and require continuous squeezing of a bulb to transport fuel from one point to another. The devices are not positive in action and are fragile and tend to tire the hand of the user.

A collection of prior art siphoning devices is found in Class 137, fluid handling, of the Official Classification of the United States Patents. In that class, and particularly in the siphon subclasses, beginning with subclass 123, are found United States Patents officially classified there as well as United States Patents unofficially collected by examiners and publications and foreign patents collected by examiners.

Examples of patents which are found in those subclasses are: U.S. Pat. Nos. 1,440,706; 108,087; 201,746; 135,935; 2,830,608; 108,652; 919,079; 958,415; 11,867; 2,233,123 and 3,588,293.

Many of the patents have pumps at the outlet end of siphons; however, these pumps are constructed to permit a continual flow through the pump base as the siphon drains the higher level chamber. Examples of such devices are found in U.S. Pat. No. 1,440,706 with a laterally connected pump, U.S. Pat. No. 108,087 with a laterally connected pump having a plunger parallel to the siphon, U.S. Pat. No. 201,746 with a similar pump and U.S. Pat. No. 135,935 with a pump connected in the flow line.

None of those patents suggest the siphon and pump combination of the present invention.

U.S. Pat. Nos. 2,830,608 and 108,652 were selected as examples of pumps on the inlet side of siphons.

U.S. Pat. Nos. 919,079 and 958,415 were selected as examples of siphons operated by pulling a plunger through an elongated portion of the siphon tube.

U.S. Pat. No. 11,867 describes a similar type device in which the fluid flow is started by sliding a cylinder outward.

U.S. Pat. No. 2,233,123 shows a combination of the two previous types of siphon starters.

U.S. Pat. No. 3,588,293 is an example of a recent siphon patent.

No reference suggested connecting a siphon starting pump with a short length of tubing which could be pulled from the main siphon tube after the flow was started.

SUMMARY OF THE INVENTION

A short tube fits within one end of the long tube, and the short tube is connected to an end of a piston pump; drawing outward on the pump handle draws fluid up the main siphon tube. A continued pull outward on the pump handle pulls the small tube from the long tube, disconnecting the pump from the main siphon tube and permitting the siphon to continue functioning.

In a preferred embodiment of the invention, the main suction tube is connected of a long, soft, flexible tube which has walls sufficiently thick to provide long wear and to give the tube cross-sectional form stability. The tube should be constructed from a material which is inert or highly resistant to the fluid material intended to be transported through the tube and to the environment in which the tube is used and is stored. A highly suitable material for the tube is polytetraethylene or the well known commercial embodiment Teflon. Other polymeric materials may be useful such as nylon, polyethylene or polypropylene.

In one embodiment of the invention, the distal end of the tube and the proximal end of the tube are constructed similarly as open ends. In another embodiment, the ends may be constructed differentially with plural openings near the distal end which is inserted in the tank of fluid to be withdrawn. The plural openings ensure against blockage of the intake openings during fluid flow. The distal end of the tube may be closed with small peripheral openings around the tube spaced slightly from the distal end to prevent the lifting of undesirable fluids or solids from an obscure bottom of a tank.

In the preferred embodiment, the proximal end of the main suction tube is open at the axial end.

In a preferred embodiment of the invention, a connection tube is positioned within the main siphon tube, and a portion of the connection tube extends from the proximal end of the main siphon tube. The connection tube is made similar to the main siphon tube, but the outer diameter of the connection tube is substantially equivalent to the inner diameter of the main siphon tube at its proximal end. Preferably, the main siphon tube has a similar inner diameter throughout its length. Alternatively the proximal end of the main siphon tube may be necked down or its opening may be inwardly beaded to promote good sealing with the connection tube.

In a preferred embodiment, a slight, almost indiscernible clearance is provided between the outer surface of the connection tube and the inner surface of the main suction tube, and that clearance is closed by holding the distal end of the main tube with slight compressive pressure around the connection tube.

In a preferred form of the invention, a distal end of the connection tube is well inside of the main siphon tube at the beginning. Preferably, the distal end of the connection tube should be at least four inches and may be any distance inside the main suction tube. A distance of four to ten inches is preferred for good sealing in the initial step and for ease of withdrawal in the subsequent step.

Preferably, the distal end of the connection tube is permanently joined to a nipple on an intake side of an evacuating pump.

The proximal end of the connection tube may be connected externally or internally to the nipple. The distal end of the connection tube may be connected externally or internally to the main siphon tube.

In a preferred embodiment, the connection tube is mounted internally in the main siphon tube, and the nipple is mounted internally in the connection tube. In that case, the outer surface of the nipple may be deformed to ensure permanent connection. Alternatively, the nipple and connection tube may be permanently bonded or fused. Preferably, the nipple is threaded, and the connection tube is screwed on to the threads.

In a preferred embodiment, the main siphon tube proximal end, the connection tube and the pump, the nipple, the pump cylinder and the plunger are all interconnected in a single axial direction. The pump is formed of a single cylinder, capped at opposite ends. The cap at the intake end is tightly sealed to the cylinder, and the nipple is permanently sealed to the cap in communication with the cylinder intake end. In the cap at the other end of the cylinder may be a removable cap and may be provided with openings for permitting free ingress and egress of air. A plunger extends through the hole in the center of the second cap, and a piston is connected to the plunger within the cylinder. In one embodiment, the piston is comprised of circular plates which sandwich a diaphragm and which hold the diaphragm against the cylinder wall. The diaphragm periphery extends towards the second cap from the plates so that pulling the plunger outward tends to press the diaphragm periphery against the cylinder wall, sealing the chamber between the piston and the intake end. Pushing the plunger inward toward the cylinder forces air out of the chamber around the loose periphery of the diaphragm toward the second nonactive end of the chamber. A tightly fitting piston may be employed with a check valve or flap on the side of the piston opposite the working chamber to permit flow in a single direction out of the chamber when the chamber is compressed by driving the plunger and piston toward the intake end.

One or more pulls on the plunger draw fluid up in the main siphon tube. A continued outward pull on the plunger in the evacuating direction pulls the piston against the second end cap and pulls the entire pump cylinder, nipple and connection tube outward, finally withdrawing the connection tube from the main siphon tube.

One object of the invention is the provision of a siphon which has a pump axially connected to the siphon in sliding arrangement so that the pump may be withdrawn from the siphon by a continued outward movement.

Another object of the invention is the provision of a connection means between a pump and siphon apparatus which permits disconnection of the pump from the siphon apparatus upon continued outward pull of a pump plunger.

Another object of the invention is the provision of a siphon apparatus comprising an elongated tube having a distal end for inserting in a tank containing fluid to be siphoned and having a proximal end for flowing out siphoned fluid, a connector tube positioned in the main tube through the proximal end, the connector tube having a distal end within the main tube and having a proximal end extending from the proximal end of the main tube, an evacuating pump having a cylinder with an inlet end, a nipple connected to the inlet end of the cylinder and inserted in the proximal end of the connector tube, and the pump having a piston positioned within the cylinder and a plunger connected to the piston and extending out of the cylinder remote from the inlet end, and a handle on an end of the plunger remote from the piston, whereby pulling outward on the handle creates a reduced pressure within the cylinder and thereby within the nipple, within the connection tube and within the main tube, and whereby further pulling outward on the handle pulls the connection tube from the main tube, permitting free unobstructed flow of siphoned fluid from the main tube.

These and other objects and features of the invention are apparent in the foregoing and ongoing specification and claims and the drawings.

DETAILED DESCRIPTION OF THE DRAWINGS

Figure 1:
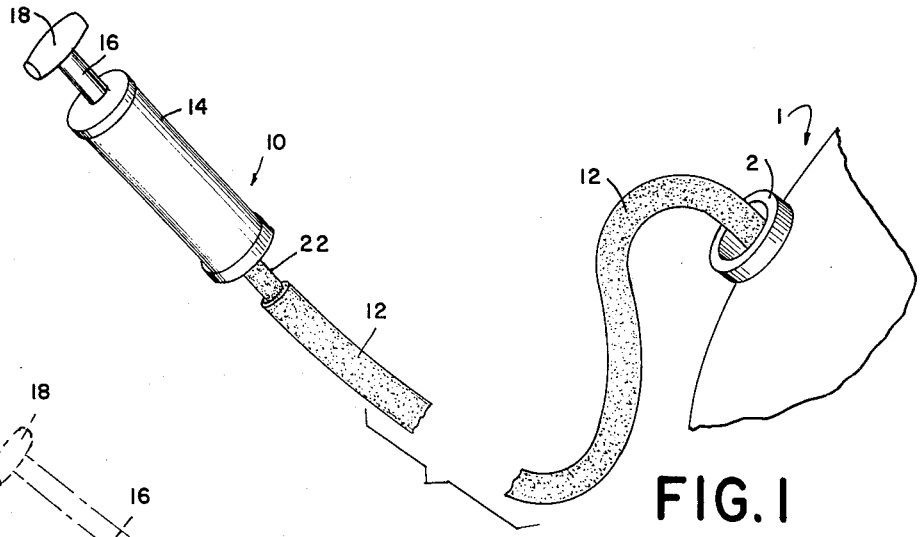
FIG. 1 is a schematic representation of the siphon of the present invention.

Referring to the drawings, a tank which may be an automobile tank is generally referred to by the numeral 1. The tank has an opening 2 through which the tank is normally filled.

A siphon used to remove fluids from the tank 1 is generally referred to by the numeral 10. Siphon 10 has a long main siphon tube 12 which has a distal end positioned within tank 1. A proximal end of main siphon tube 12 is shown at the left. The proximal end of the main siphon tube is connected to a pump which has a cylinder 14 constructed of a single rigid plastic or metal tube. A plunger 16 extends into cylinder 14. A piston is connected to an end of plunger 16 within cylinder 14, and a handle 18 is connected to the external end of plunger 16. An upper cap on cylinder 14 loosely surrounds plunger 16 to provide free ingress and egress of air as the plunger is operated. A lower cap tightly encloses the lower end of cylinder 14 and communicates nipple 20 with the chamber formed by the piston, the cylinder and the lower cap. The nipple 20 is permanently sealed to the lower cap. A connection tube 22 is permanently connected to nipple 20, and a distal end of connection tube 22 is held within the proximal end of main siphon tube 12. Plunger 16 is operated by pulling the plunger outward to partially evacuate main siphon tube 12 and to draw fluid from tank 1 up into the main siphon tube. As fluid comes up into the main siphon tube 12 a final outward stroke on plunger 16 is continued, while at the same time releasing or loosening a grip on the distal end of tube 12. The result is as shown in phantom view in FIG. 2 and in FIG. 3 with the connection tube 22 drawn out of the proximal end of main tube 12. Fluid from tank 1 continues to freely flow out of the lowered proximal end of main siphon tube 12.

Figure 2:
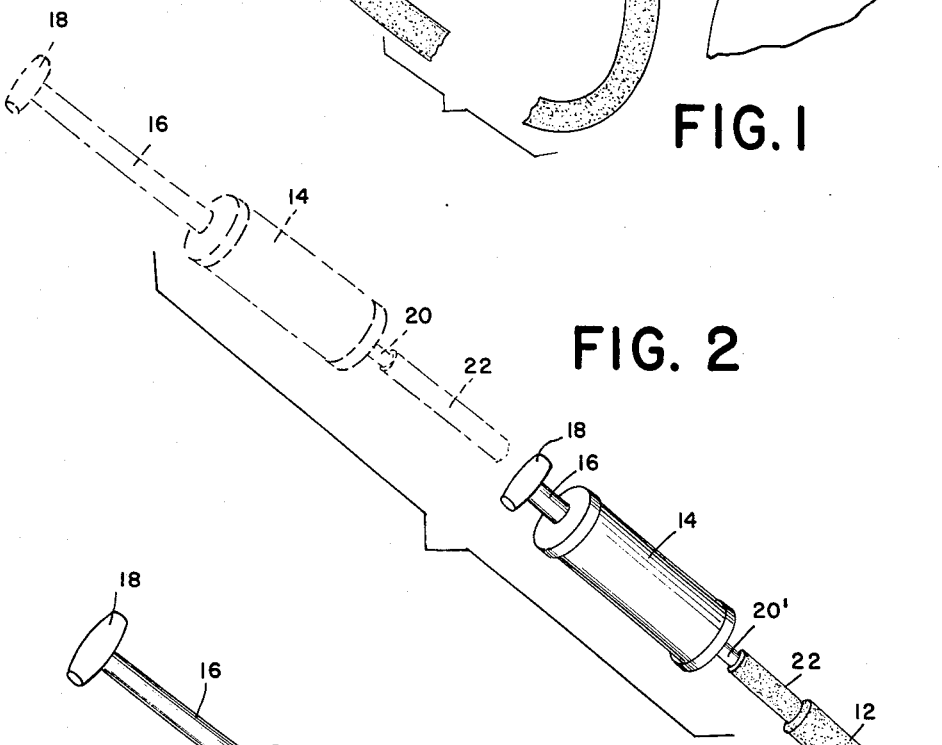
FIG. 2 is a schematic representation of the use and operation of the siphon of the present invention.

As shown in FIG. 2, the nipple has a discontinuous roughened surface.

Figure 3:
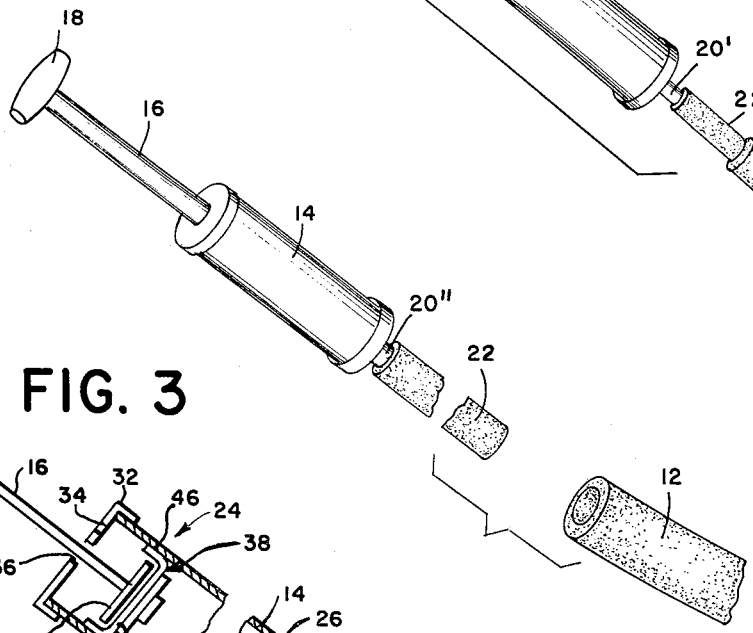
FIG. 3 is a detail of the siphon apparatus.

The nipple shown in FIG. 3 has a threaded outer surface 20'' which is tightly threaded into a proximal end of the connection tube.

Figure 4:
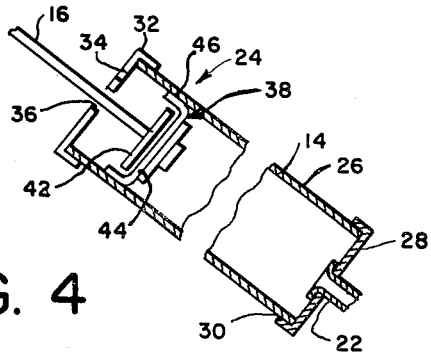
FIG. 4 is a detail of the pump.

As shown in FIG. 4, the evacuating pump is a small pump 24 with a single cylindrical wall 26, having an inside which forms the cylinder 14. A tightly fitting end cap 28 is at the inlet end 30 of the cylindrical wall 26. Nipple 22 is tightly fitted in the end cap 28. A second end cap 32 is at the remote end of the cylindrical wall 26. Second end cap 32 provides an opening 34 for free passage of air, and second end cap 32 has a central opening 36 for passage of the plunger, and wherein the piston 38 comprises circular plates 42 and 44 spaced inward from the cylindrical wall and a diaphragm 46 which extends outward from the plates to the wall and which extends partially along the wall in the direction of the plunger 16 and handle.

While the invention has been described with reference to a specific embodiment, it will be obvious to those skilled in the art that modifications and variations of the invention may be made without departing from the scope of the invention. The scope of the invention is defined in the following claims:

I claim:

1. A siphon apparatus comprising an elongated tube having a distal end for inserting in a tank containing fluid to be siphoned and having a proximal end for flowing out siphoned fluid, a connector tube positioned in the main tube through the proximal end, the connector tube having a distal end within the main tube and having a proximal end extending from the proximal end of the main tube, an evacuating pump having a cylinder with an inlet end, a nipple connected to the inlet end of the cylinder and inserted in the proximal end of the connector tube, and the pump having a piston positioned within the cylinder and a plunger connected to the piston and extending out of the cylinder remote from the inlet end, and a handle on an end of the plunger remote from the piston, whereby pulling outward on the handle creates a reduced pressure within the cylinder and thereby within the nipple, within the connection tube and within the main tube, and whereby further pulling outward on the handle pulls the connector tube from the main tube, permitting free unobstructed flow of siphoned fluid from the main tube.

2. The apparatus of claim 1 wherein the main siphon tube and the connection tube are constructed of transparent flexible material.

3. The apparatus of claim 1 wherein the connection tube is a relatively short tube.

4. The apparatus of claim 1 wherein an outer wall of the connection tube and an inner wall of the main siphon tube have a slippery interface.

5. The apparatus of claim 1 wherein an outer wall of the connection tube closely fits within an inner wall of the main siphon tube.

6. The apparatus of claim 1 wherein the nipple has a discontinuous roughened surface.

7. The apparatus of claim 1 wherein the nipple has a threaded outer surface which is tightly threaded into a proximal end of the connection tube.

8. The apparatus of claim 1 wherein the evacuating pump is a small pump with a single cylindrical wall, having an inside which forms the cylinder and having a tightly fitting end cap at the inlet end of the cylindrical wall, wherein the nipple is tightly fitted in the end cap and having a second end cap at the remote end of the cylindrical wall, which second end cap provides an opening for free passage of air and which second end cap has a central opening for passage of the plunger, and wherein the piston comprises circular plates spaced inward from the cylindrical wall and a diaphragm which extends outward from the plates to the wall and which extends partially along the wall in the direction of the plunger and handle.

9. A siphoning method comprising inserting a distal end of an elongated main tube in a tank containing fluid to be siphoned, positioning a connector tube in a proximal end of the main tube, the connector tube having a distal end within the main tube and having a proximal end extending from the proximal end of the main tube connecting to the connector tube, connecting to the connector tube an evacuating pump having a cylinder with an inlet end by inserting a nipple connected to the inlet end of the cylinder into the proximal end of the connector tube, positioning a piston within the cylinder near the inlet end and connecting a plunger to the piston and extending the plunger out of a second end of the cylinder remote from the inlet end, pulling outward on a handle on an end of the plunger remote from the piston and creating a reduced pressure within the cylinder and thereby within the nipple, within the connection tube and within the main tube, contacting a second end of the cylinder with the plunger and continuing pulling outward on the handle and pulling on the cylinder, nipple and connector tube, and thereby pulling the connector tube from the main tube, permitting free unobstructed flow of a siphoned fluid from the main tube.

* * * * *